US010108132B2

(12) United States Patent
Kawanago

(10) Patent No.: US 10,108,132 B2
(45) Date of Patent: Oct. 23, 2018

(54) IMAGE FORMING APPARATUS AND CLEANING APPARATUS HAVING A RIGID METAL BLADE CLEANER

(71) Applicant: KONICA MINOLTA, INC., Chiyoda-ku, Tokyo (JP)

(72) Inventor: Takashi Kawanago, Fuchu (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/695,985

(22) Filed: Sep. 5, 2017

(65) Prior Publication Data

US 2018/0067446 A1 Mar. 8, 2018

(30) Foreign Application Priority Data

Sep. 6, 2016 (JP) ..... 2016-173257

(51) Int. Cl.
*G03G 21/00* (2006.01)
*G03G 15/16* (2006.01)

(52) U.S. Cl.
CPC ..... *G03G 21/0011* (2013.01); *G03G 15/161* (2013.01); *G03G 21/0029* (2013.01)

(58) Field of Classification Search
CPC ..... G03G 15/161; G03G 15/0189; G03G 21/0011; G03G 21/0029; G03G 2215/1661; G03G 2221/0089
USPC ..... 399/101, 350
See application file for complete search history.

(56) References Cited

U.S. PATENT DOCUMENTS

| | | | | |
|---|---|---|---|---|
| 7,962,085 | B2 * | 6/2011 | Thayer | G03G 21/0011 399/350 |
| 8,295,747 | B2 * | 10/2012 | Sakka | G03G 15/162 399/302 |
| 9,575,438 | B2 | 2/2017 | Takai et al. | |
| 9,720,353 | B2 * | 8/2017 | Sakamoto | G03G 15/162 |
| 2005/0135844 | A1 * | 6/2005 | Takenouchi | G03G 15/0131 399/297 |
| 2007/0140761 | A1 * | 6/2007 | Sugimoto | G03G 21/0017 399/350 |
| 2007/0147876 | A1 * | 6/2007 | Moro | G03G 15/161 399/101 |
| 2012/0027473 | A1 * | 2/2012 | Yamashita | G03G 15/0131 399/308 |

(Continued)

FOREIGN PATENT DOCUMENTS

| | | | |
|---|---|---|---|
| JP | 06027860 | A * | 2/1994 |
| JP | 06332350 | A * | 12/1994 |
| JP | 2006178232 | A * | 7/2006 |

(Continued)

*Primary Examiner* — Robert Beatty
(74) *Attorney, Agent, or Firm* — Holtz, Holtz & Volek PC

(57) ABSTRACT

An image forming apparatus which transfers a toner image formed on an image carrier onto a transfer object and forms an image, the apparatus including: a cleaner which has a rigid blade made of metal that contacts the image carrier after transferring of the toner image onto the transfer object and cleans a residue attached to a surface of the image carrier, wherein the image carrier has a base layer and an elastic layer, and a surface hardness of the elastic layer measured by a nanoindentation method is 70 MPa or more and 150 MPa or less, and a thickness of the rigid blade is 100 μm or more and 300 μm or less.

12 Claims, 5 Drawing Sheets

(56) References Cited

U.S. PATENT DOCUMENTS

2016/0026146 A1* 1/2016 Takai ..... G03G 15/161
399/350

FOREIGN PATENT DOCUMENTS

| | | | | |
|---|---|---|---|---|
| JP | 2009069455 | A | * | 4/2009 |
| JP | 4539135 | B2 | | 9/2010 |
| JP | 2016031426 | A | | 3/2016 |

* cited by examiner

IMAGE FORMING APPARATUS AND CLEANING APPARATUS HAVING A RIGID METAL BLADE CLEANER

BACKGROUND

1. Technological Field

The present invention relates to an image forming apparatus and a cleaning apparatus.

2. Description of the Related Art

As an electrophotographic image forming apparatus, for example, there has been conventionally an intermediate transfer type image forming apparatus which forms toner images of Y (yellow), M (magenta), C (cyan) and K (black) on separate photoreceptor drums, primarily transfers the toner images of the respective Y, M, C and K colors formed on the respective photoreceptor drums onto a rotating intermediate transfer belt so as to be superposed on each other and thereafter secondarily transfers the respective superposed toner images transferred on the intermediate transfer belt onto a sheet of paper.

The intermediate transfer belt formed of a resin material such as polyimide and polyphenylene sulfide is generally and widely adopted. However, due to the microscopic irregularities in the surface shape of paper type to be used (for example, plain paper, thin coated paper and thick paper), the contact property between an intermediate transfer belt and a sheet at the secondary transfer position is lowered, and thus it is difficult to ensure the transfer property in some cases.

In order to prevent such decrease in the transfer property, there is an intermediate transfer belt which has an elastic layer formed of a rubber material or the like on a substrate layer formed of a resin material. The elastic layer enables the intermediate transfer belt to have the surface shape deformed so as to fit the surface shape of the sheet, and thus improves the contact property between the intermediate transfer belt and the sheet.

It is desired that all toner images are transferred onto a sheet when transferring the toner images on an intermediate transfer belt onto the sheet. However, there are actually cases where a part of the toner particles are not transferred and remain on the intermediate transfer belt. There are also cases where paper powders are attached to the intermediate transfer belt due to the contact between the sheet and the intermediate transfer belt. If such residues of residual toners and paper powders remain attached to the intermediate transfer belt, the formation of toner images thereafter is disturbed. Thus, the image forming apparatus is provided with a cleaning apparatus which removes residues on the intermediate transfer belt.

The cleaning apparatus generally has a configuration of scraping and removing the residues on the intermediate transfer belt by making the tip of a cleaning blade (rigid blade) formed of a thin metal piece come into contact with the rotating intermediate transfer belt (for example, see Japanese Patent Application Laid Open Publication No. 2016-31426 and Japanese Patent No. 4539135).

In such a configuration, for example, the frictional force against the intermediate transfer belt is reduced and the belt drive torque does not increase easily compared to a case of using a cleaning blade formed of an elastic body such as urethane rubber. Thus, there is a merit of reducing problems caused by the torque increase such as unstable drive of the intermediate transfer belt and generation of drive irregularities leading to image irregularities, and slip between drive rollers and the intermediate transfer belt leading to stop of the rotation of the intermediate transfer belt.

However, the cleaning apparatus using a rigid blade has had a phenomenon of edge lift that the contact angle between the rigid blade and the intermediate transfer belt is changed and the upstream side of the blade abrasion surface is separated away from the belt. Especially, the edge lift easily occurs when the environment changes.

Here, the edge lift which occurs when the environment changes will be described by using FIGS. 6 and 7.

Normally, the frictional force between the intermediate transfer belt and the rigid blade is large under a high-temperature high-humidity environment (30° C. and 80%; hereinafter, referred to as "HH environment"), and the frictional force is small under a low-temperature low-humidity environment (10° C. and 20%; hereinafter, referred to as "LL environment").

When the frictional force increases under the HH environment, as shown by the solid line in FIG. 6, the pulling force by the belt of the rigid blade is increased. When the pulling force is increased, the blade holding member holding the rigid blade is rotated by receiving a force resisting a biasing force by a spring, and the contact angle of the blade with respect to the belt is increased.

On the other hand, when the frictional force decreases under the LL environment, as shown by the chain double-dashed line in FIG. 6, the pulling force by the belt of the rigid blade is decreased. When the pulling force is decreased, the blade holding member holding the rigid blade is rotated in the opposite direction to the case of HH environment due to decrease of the force resisting the biasing force by the spring, and the contact angle of the blade with respect to the belt is decreased.

FIG. 7 is a view showing the contact state of the tip of the rigid blade with respect to the intermediate transfer belt when the environment changes during use. Time elapses in the order of (1), (2) and (3) in FIG. 7.

(1) is a contact state under the HH environment in an initial state. Abrasion has not yet been generated in the edge of the rigid blade, and the abrasion surface does not exist. The contact angle (θ) is relatively high.

When the image formation is continued in this state, the contact edge of the rigid blade is abraded by the passage of an external additive between the blade and the belt, and an abrasion surface is formed in the blade edge as shown in (2). The angle of the abrasion surface is an angle corresponding to the contact angle.

Thereafter, when the abrasion surface with a constant width is formed and then the environment changes from the HH environment to the LL environment, the contact state becomes the contact state shown in (3). At this time, the contact angle of the blade is decreased compared to the contact angle at the time of the HH environment for the above-mentioned reason. In the rigid blade, deformation of the blade according to the angle change does not occur since the contact portion is not deformable. Thus, when the contact angle is changed from a large angle to a small angle, the tip side of the abrasion surface is separated from the belt, and there is generated a wedge-shaped space (edge lift) between the abrasion surface and the belt. When the width of the environmental change is larger and the change of the contact angle according to the environmental change is larger, the interval of the tip lift is also larger.

When the interval reaches a certain value or more, the toners enter the wedge-shaped space. The toner particles entering the wedge-shaped space easily go through under the blade since the stopping force to the upstream side by the blade is weak.

Thus, when the edge lift occurs, a cleaning defect is generated and the toners which went through are attached as a noise onto an image after one rotation of the belt, leading to a quality problem.

As described above, in a case where the usage environment changes, the edge lift is generated, and when the edge lift is generated, the cleaning property becomes excessively worse. Accordingly, it is important to avoid the generation of the edge lift under the use condition in a cleaning apparatus which uses a rigid blade.

SUMMARY

The present invention has been made in consideration of the above problems, and an object of the present invention is to achieve a good cleaning property regardless of a use condition in a case of adopting a cleaning apparatus which has a rigid blade.

To achieve at least one of the abovementioned objects, according to an aspect of the present invention, an image forming apparatus reflecting one aspect of the present invention transfers a toner image formed on an image carrier onto a transfer object and forms an image, the apparatus including: a cleaner which has a rigid blade made of metal that contacts the image carrier after transferring of the toner image onto the transfer object and cleans a residue attached to a surface of the image carrier, wherein the image carrier has a base layer and an elastic layer, and a surface hardness of the elastic layer measured by a nanoindentation method is 70 MPa or more and 150 MPa or less, and a thickness of the rigid blade is 100 μm or more and 300 μm or less.

BRIEF DESCRIPTION OF THE DRAWINGS

The advantages and features provided by one or more embodiments of the invention will become more fully understood from the detailed description given hereinafter and the appended drawings which are given by way of illustration only, and thus are not intended as a definition of the limits of the present invention, and wherein.

DETAILED DESCRIPTION OF EMBODIMENTS

Hereinafter, one or more embodiments of the present invention will be described with reference to the drawings. However, the scope of the invention is not limited to the disclosed embodiments, nor limited to the illustrated examples.

First, the configuration of an image forming apparatus in an embodiment will be described.

Figure 1:
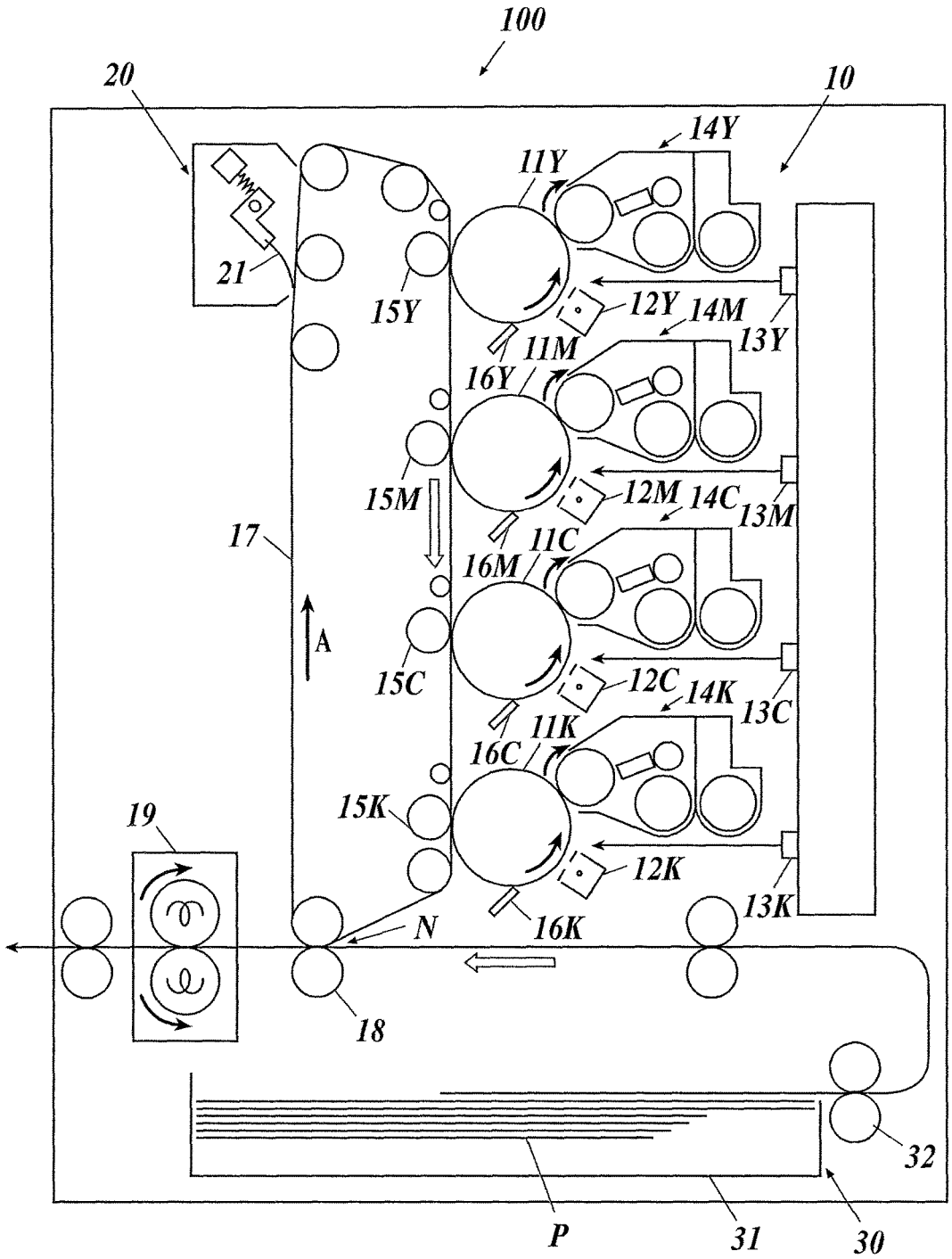
FIG. 1 is a schematic configuration view of an image forming apparatus in an embodiment of the present invention.
Figure 2:
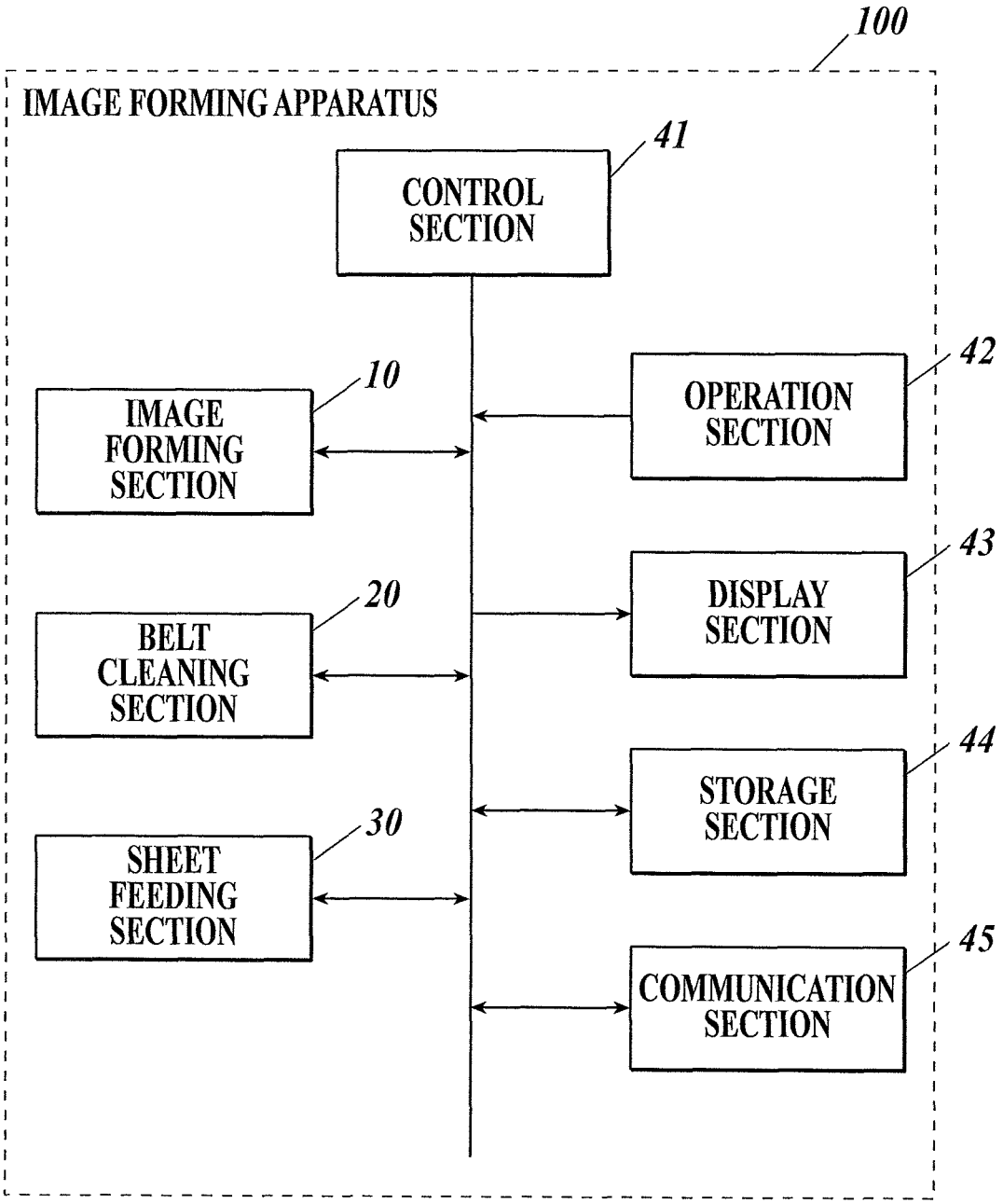
FIG. 2 is a functional block diagram showing a control configuration of the image forming apparatus.

FIG. 1 is a schematic configuration view of an image forming apparatus 100. FIG. 2 is a block diagram showing the functional configuration of the image forming apparatus 100.

As shown in FIGS. 1 and 2, the image forming apparatus 100 is configured by including an image forming section 10, a belt cleaning section (cleaner, cleaning apparatus) 20, a sheet feeding section 30, a control section 41, an operation section 42, a display section 43, a storage section 44, a communication section 45 and such like, and the sections are connected to each other by a bus.

The image forming section 10 includes photoreceptor drums 11Y, 11M, 11C and 11K, charging sections 12Y, 12M, 12C and 12K, exposure sections 13Y, 13M, 13C and 13K, developing sections 14Y, 14M, 14C and 14K, primary transfer rollers 15Y, 15M, 15C and 15K, photoreceptor cleaning sections 16Y, 16M, 16C and 16K which are corresponding to respective colors of yellow (Y), magenta (M), cyan (C) and black (K), an intermediate transfer belt 17 as an image carrier, secondary transfer rollers 18 and a fixing section 19.

The charging sections 12Y, 12M, 12C and 12K uniformly charge the respective photoreceptor drums 11Y, 11M, 11C and 11K.

The exposure sections 13Y, 13M, 13C and 13K are configured by including laser light sources, polygon mirrors, lens and such like, and form electrostatic latent images by scanning and exposing the surfaces of respective photoreceptor drums 11Y, 11M, 11C and 11K with laser beams on the basis of the image data of the respective colors.

The developing sections 14Y, 14M, 14C and 14K attach the toners of respective colors to the electrostatic latent images on the photoreceptor drums 11Y, 11M, 11C and 11K to perform development.

The primary transfer rollers 15Y, 15M, 15C and 15K sequentially transfer the toner images of respective colors formed on the photoreceptor drums 11Y, 11M, 11C and 11K onto the intermediate transfer belt 17 (primary transfer). That is, a color toner image of superposed toner images in four colors is formed on the intermediate transfer belt 17.

The photoreceptor cleaning sections 16Y, 16M, 16C and 16K remove the toners remaining on the circumferential surface of the respective photoreceptor drums 11Y, 11M, 11C and 11K after transferring.

The intermediate transfer belt 17 is an endless belt having an elastic layer, tensioned by a plurality of rollers (drive rollers, tension rollers, driven rollers) and rotated in the direction shown by the arrow A in FIG. 1. The details of the configuration of the intermediate transfer belt 17 will be described later.

The secondary transfer rollers 18 transfer all the color toner images formed on the intermediate transfer belt 17 at once onto one surface of a sheet (transfer object) P as a transfer object supplied from the sheet feeding section 30 (secondary transfer).

The fixing section 19 fixes the toners transferred on the sheet P onto the sheet P by heating and pressurizing.

The belt cleaning section 20 cleans the intermediate transfer belt 17 by removing residues such as residual toners, which remain without being transferred onto the sheet P, and paper powders from the intermediate transfer belt 17 after the color toner images were transferred onto the sheet P by the secondary transfer rollers 18. The details of the configuration of the belt cleaning section 20 will be described later.

The sheet feeding section 30 is provided in the lower section of the image forming apparatus 100, and includes a sheet feeding cassette 31 which is detachable. The sheets P contained in the sheet feeding cassette 31 are sent from the uppermost sheet one by one to the conveyance path by the sheet feeding rollers 32.

The control section 41 is configured by including a CPU (Central Processing Unit), a ROM (Read Only Memory), a RAM (Random Access Memory) and such like, and integrally controls the processing operations of sections in the image forming apparatus 100. The CPU reads out various processing programs stored in the ROM, loads them into the RAM and executes the various types of processing in accordance with the loaded programs.

The operation section 42 includes a touch panel formed so as to cover the display screen of the display section 43 and various operation buttons such as numeric buttons and start button, and outputs an operation signal based on user's operation to the control section 41.

The display section 43 is configured by including an LCD (Liquid Crystal Display), and displays various screens in accordance with the instruction of a display signal input from the control section 41.

The storage section 44 is formed of a storage device such as a non-volatile semiconductor memory and hard disk, and stores data regarding the various processing and such like.

The communication section 45 transmits and receives data to and from an external device connected to a network such as a LAN (Local Area Network).

[Configuration of Intermediate Transfer Belt]

Next, the configuration of the intermediate transfer belt 17 will be described in detail.

Figure 3:
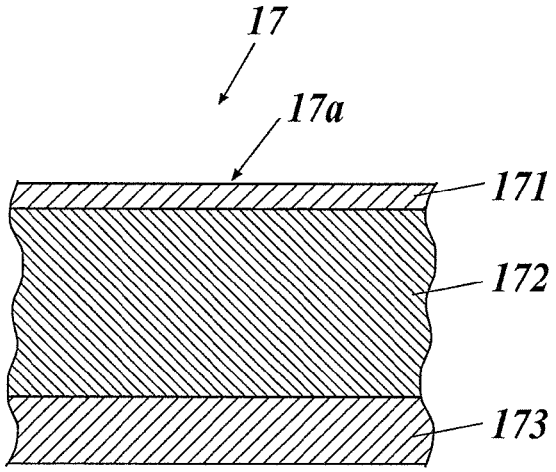
FIG. 3 is a cross-sectional view of an intermediate transfer belt.

FIG. 3 is a cross sectional view of the intermediate transfer belt 17. In FIG. 3, the upper side is the outer circumferential side of the intermediate transfer belt 17.

The intermediate transfer belt 17 is configured by including a surface layer 171, an elastic layer 172 and a base layer 173 in order from the outer circumferential side. The upper surface of the surface layer 171 is referred to as an outer circumferential surface 17*a*.

The surface layer 171 is a layer which is provided on the uppermost circumference of the intermediate transfer belt 17 and for enhancing the releasability of toners on the outer circumferential surface 17*a* of the intermediate transfer belt 17.

The elastic layer 172 is a layer which is located on the inner circumference side of the surface layer 171, and for sufficiently ensuring the nip width of a nip section N (see FIG. 1) between the intermediate transfer belt 17 and the secondary transfer rollers 18.

The elastic layer 172 is a layer for enhancing followability of the outer circumferential surface 17*a* of the intermediate transfer belt 17 with respect to the surface of the sheet P.

By such elastic layer 172, the transfer of the toner image at the nip section N is performed well even in a case of using embossed paper having irregularities on the surface as the sheet P, for example.

In order to achieve the above function, the surface layer 171 is configured to be harder than the elastic layer 172.

The surface hardness of the surface layer 171 can be measured by a nanoindentation method, for example. The nanoindentation method is a test technique of obtaining a mechanical nature of a material by continuously measuring a test force (force loaded by an indenter) and a pressing depth (change amount of the indenter) and analyzing the obtained pressing curve in a process of forming a recess by pressing the indenter applying a predetermined load to the surface of a sample.

Specifically, the surface hardness of the surface layer 171 is 70 to 150 MPa.

In a case where the surface hardness is less than 70 MPa, that is, the uppermost surface is excessively soft, the toners deform the elastic layer 172, go through under the edge of the rigid blade 21 (to be described later) and generate cleaning defects. On the other hand, in a case where the surface hardness is larger than 150 MPa, that is, the uppermost surface is excessively hard, when there are contact irregularities in the ridge direction of the rigid blade 21 which is not deformable, the surface of the intermediate transfer belt 17 cannot follow the irregularities, minute gaps are generated, toners go through, and the cleaning defects are generated.

As the elastic layer 172, nitrile-butadiene rubber (NBR) can be used. The material is not limited to this, and the elastic layer 172 can be formed of other rubber materials such as chloroprene rubber, polybutadiene rubber, isoprene rubber, urethane rubber, EPDM (ethylene-propylene-diene rubber), acrylic rubber and silicone rubber.

The surface processing may be performed to the surface of the member forming the elastic layer 172, and the portion which was subjected to the surface processing can be the surface layer 171.

Specifically, the surface layer 171 can be formed to have a defined surface hardness by performing known surface hardness modification processing such as oxidation treatment and isocyanate processing to the elastic layer 172 which is NBR.

The isocyanate processing is the processing of impregnating the surface of the elastic layer 172 with the isocyanate compound, and thereafter performing heating to cause a reaction. The isocyanate processing allows hardening the surface of the elastic layer 172 to a desired hardness by appropriately adjusting the impregnation amount, heating temperature and heating time of the isocyanate compound. As the isocyanate compound used in the isocyanate processing, aromatic isocyanate, aliphatic isocyanate and such like are used. Specifically, toluene diisocyanate (TDI), diphenylmethane diisocyanate (MDI), crude MDI and such like can be used. In a case where the elastic layer 172 is NBR, hypochlorite can also be used.

Furthermore, the surface layer 171 can also be formed by performing known surface hardness modification processing such as oxidation treatment and isocyanate processing to the elastic layer 172 formed of a rubber material illustrated as the usable material other than NBR.

The surface layer 171 and the elastic layer 172 can be configured by different members.

In this case, the surface layer 171 can be formed of fluororesin or ceramics, for example.

As the fluororesin forming the surface layer 171, there can be used polytetrafluoroethylene (PTFE), tetrafluoroethylene-perfluoroalkylvinylether copolymer (PFA), tetetrafluoroethylene-hexafluoropropylene copolymer (FEP), polychlorotrifluoroethylene (PCTFE), ethylene-tetrafluoroethylene copolymer (ETFE), ethylene-chlorotrifluoroethylene copolymer (ECTFE), polyvinylidene fluoride (PVDF), polyvinyl fluoride (PVF) and such like.

As the ceramics forming the surface layer 171, there can be used silicon oxide such as silicon dioxide ($SiO_2$), oxide of aluminum, oxide of titanium, oxide of zinc and such like.

In a case of forming the surface layer 171 by the ceramics, for example, the plasma CVD method at the atmospheric pressure can be preferably used.

Though the surface layer 171 may be formed of the above fluororesin alone, the surface layer 171 may be formed of a material obtained by dispersing the fluororesin in a binder described below as an example. The fluororesin alone is not excellent in film formation, whereas the material obtained by dispersing the fluororesin in the binder enables forming a desired surface layer 171 easily.

As the binder, there can be used thermoplastic resin or thermosetting resin, such as polyurethane, polyolefin, polyester, polyamide, polystyrene, acrylic resin, styrene-acrylic copolymer, polycarbonate and vinyl chloride.

Though the contained amount of fluororesin is not especially limited, a desired contained amount is 10 wt % or more in order to lower the frictional coefficient of the surface layer 171 to some degree and ensure releasability of toners. In order to form the surface layer 171 by using the material obtained by dispersing the fluororesin in the binder, for example, a material obtained by dissolving the binder and the fluororesin in an appropriate solvent may be applied onto the elastic layer 172 and thereafter dried.

The base layer 173 of the intermediate transfer belt 17 is a layer which is located on the further inner side than the elastic layer 172, and for ensuring rigidity in the intermediate transfer belt 17. Since the rigidity of the intermediate transfer belt 17 is sufficiently ensured by the base layer 173, it is possible to superpose the toner images of the respective colors on the intermediate transfer belt 17 at the primary transfer with a high accuracy.

The base layer 173 can use polyimide (PI).

For the base layer 173, other synthetic resins can also be used. Specifically, the base layer 173 can be formed of thermoplastic resin and the like such as polyamide, PC (polycarbonate), PVDF (polyvinylidene fluoride), PAT (polyalkylene terephthalate), blend material of PC and PAT, blend material of ETFE (ethylene-tetrafluoroethylene copolymer) and PC and blend material of ETFE and PAT.

[Configuration of Belt Cleaning Section]

Next, the configuration of the belt cleaning section 20 will be described in detail.

Figure 4:
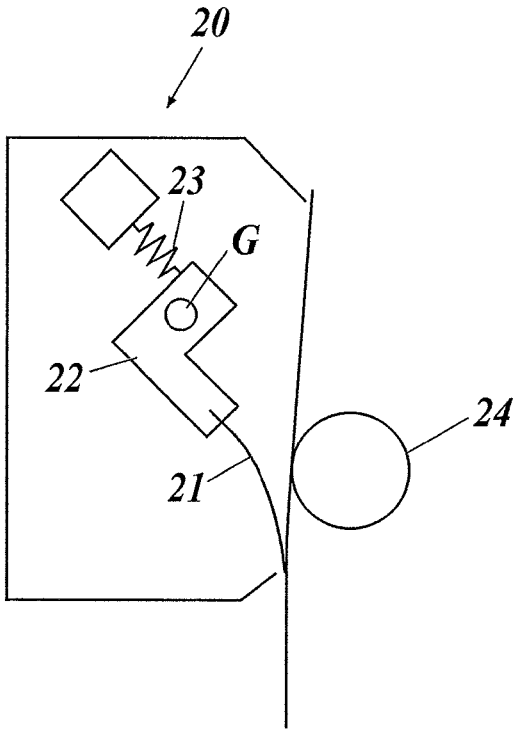
FIG. 4 is a view showing a configuration of a belt cleaning section.

FIG. 4 is a view showing the configuration of the belt cleaning section 20.

The belt cleaning section 20 includes a rigid blade 21, a blade holding member 22, a biasing spring 23 and such like.

The rigid blade 21 is a cleaning blade formed of a thin metal piece. The tip of the rigid blade 21 contacts the rotating intermediate transfer belt 17 to scrape off and remove the residues on the intermediate transfer belt 17. The rigid blade 21 is held by the blade holding member 22.

As the rigid blade 21, for example, SUS (stainless steel) can be used in consideration of hardness, workability and cost.

It is clarified that the rigid blade 21 is abraded with use by an external additive such as silica added to the toner. In order to improve abrasion resistance while suppressing the edge lift, the surface of the rigid blade 21 may be subjected to plate processing (for example, hard chrome plating or DLC plating). That is, the surface of the rigid blade 21 which is a metal plate member may be plated with a further hard metal.

The preferable Vickers hardness of such a rigid blade 21 is 100 HV or more and 3000 HV or less for good workability, low plating cost and less damage to the intermediate transfer belt 17.

The thickness of the rigid blade 21 is 100 to 300 μm.

By such a configuration, it is possible to suppress the edge lift without depending on the free length, pivot angle and Young's modulus of the rigid blade 21.

Considering that the followability to the intermediate transfer belt 17 is good in the longitudinal direction, the preferable thickness is a value within a range of 100 to 200 μm.

It is preferable that the rigid blade 21 has a round shape with a curvature radius of 4 to 10 μm in the edge at the initial use.

At this time, when the round shape of the blade edge is small, the edge lift easily occurs and there is a concern of sticking to the belt. Thus, the preferable curvature radius of the round shape is 4 μm or more.

On the other hand, when the round shape is large, the toners enter the wedge space of the edge of the rigid blade 21, deform the belt and go through. Thus, the preferable curvature radius of the round shape is 10 μm or less.

As a phenomenon which occurs when the intermediate transfer belt 17 is used, minute cracks (hereinafter, referred to as microcracks) are generated on the surface with use. Thus, in order to avoid sticking of the rigid blade 21 in the microcracks, the angle (contact angle) of the initial state in which the rigid blade 21 contacts the intermediate transfer belt 17 needs to be as small as possible within a range of avoiding the contact of the flat side of the rigid blade 21. Specifically, the preferable angle is 10 to 15°.

The blade holding member 22 is held so as to be rotatable around the rotation pivot G.

The biasing spring 23 is engaged in the blade holding member 22, and the spring force provides a pressure contact force of the rigid blade 21 with respect to the intermediate transfer belt 17.

In the configuration of FIG. 4, the biasing spring 23 is an extension spring and provides a force to rotate in a counterclockwise direction to the blade holding member 22 and the rigid blade 21, and the rigid blade 21 is in pressure contact with the intermediate transfer belt 17.

The preferable pressure contact force is 10 to 20 N/m. By such a pressure contact force, the rigid blade 21 can uniformly contact the intermediate transfer belt 17 without a gap in the longitudinal direction. Furthermore, when the rigid blade 21 with a high hardness which is not deformable contacts the surface of the intermediate transfer belt 17 having elasticity, it is possible to avoid the sticking and bounding of the rigid blade 21 caused by excessively large contact pressure.

Figure 5:
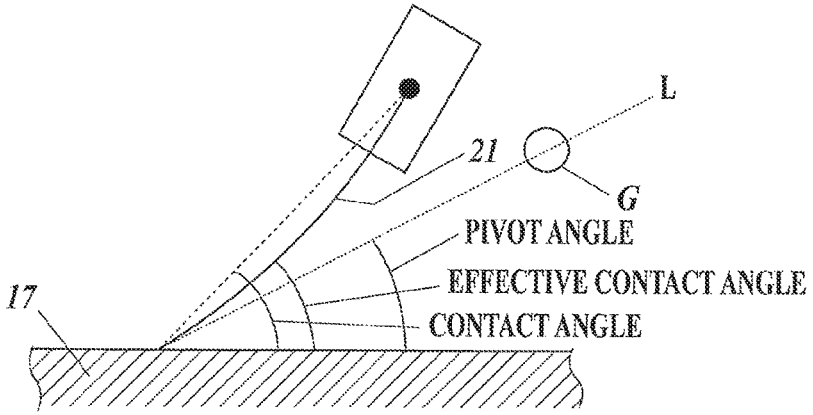
FIG. 5 is a view for explaining an angle of a rigid blade with respect to the intermediate transfer belt.
Figure 6:
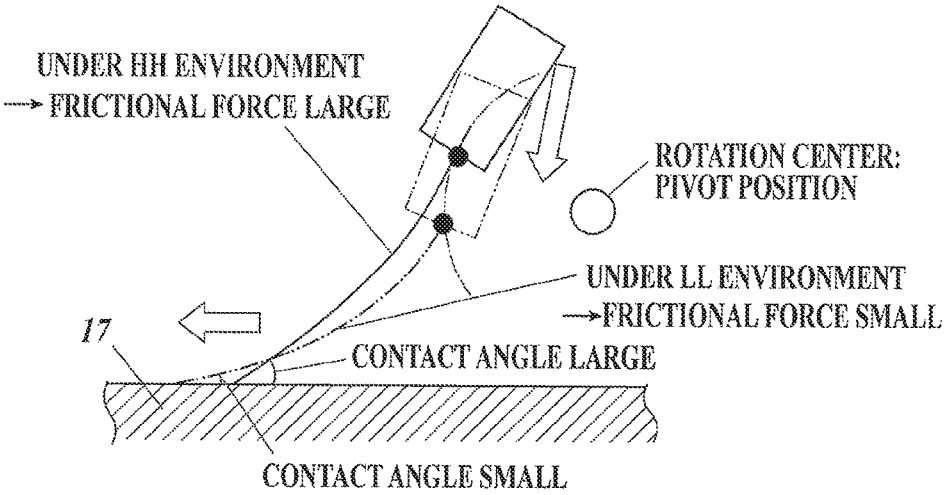
FIG.6 Prior Art
FIG. 6 is a view for explaining conventional problems.
Figure 7:
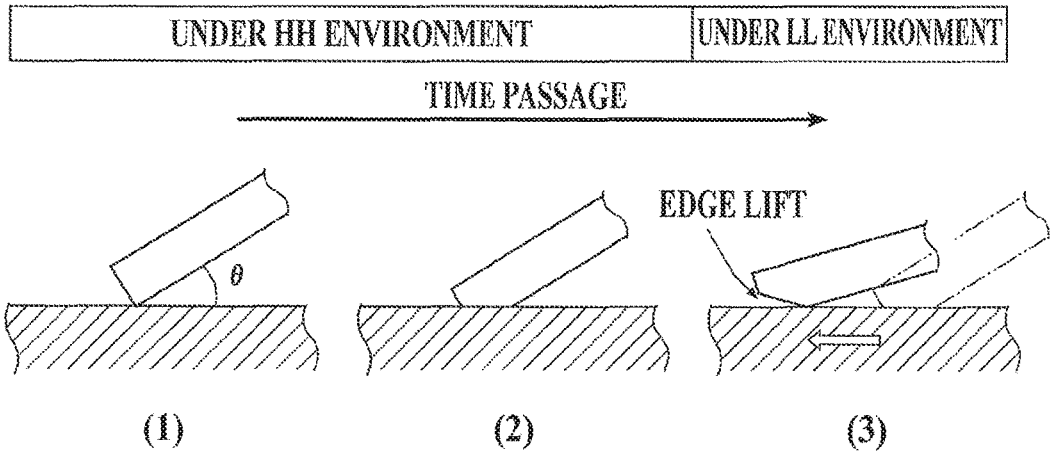
FIG. 7 Prior Art
FIG. 7 is a view for explaining conventional problems.

Here, as shown in FIG. 5, when the rigid blade 21 contacts the intermediate transfer belt 17 by a spring load, the rigid blade 21 bends since the rigid blade 21 is thin.

Thus, it is effective to the edge lift that the angle (effective contact angle) when the contact angle between the rigid blade 21 and the intermediate transfer belt 17 is changed is nearly equal to the angle (pivot angle) between the intermediate transfer belt 17 and a virtual line L connecting the rotation pivot G of the rigid blade 21 and the contact position between the rigid blade 21 and the intermediate transfer belt 17. Specifically, it is more effective to the edge lift that the angle obtained by subtracting the pivot angle from the effective contact angle is 3° or less.

It is preferable that the contact pressure of the rigid blade 21 to the intermediate transfer belt 17 is set so that the digging amount of the edge of the rigid blade 21 to the intermediate transfer belt 17, that is, the depth of the recess is a predetermined value, for example, 1 μm, which is determined in advance as a value of the belt surface roughness R or more.

When a large recess of the surface roughness R or more is generated, minute roughness existing on the surface of the intermediate transfer belt 17 is uniformed due to compression deformation by the pressing force of the edge of the rigid blade 21, the contact property with the surface of the intermediate transfer belt 17 increases more easily, and the cleaning property can be further improved.

The surface roughness R can be, for example, a value obtained by an arithmetic average roughness (Ra), a maximum height (Ry), a weighted averaging height roughness (Rz) or the like. The predetermined value of the digging amount is the value of the belt surface roughness R or more, and can be a value within a range of value avoiding early progress of the abrasion of the surface of the intermediate transfer belt 17 caused by the increase in the frictional force against the surface of the intermediate transfer belt 17 due to the digging.

It is preferable that the contact position between the rigid blade 21 and the intermediate transfer belt 17 is shifted by approximately several millimeters upstream or downstream of the range of the intermediate transfer belt 17 located around a facing roller 24.

That is, it is preferable that, at a position facing the edge of the rigid blade 21, the intermediate transfer belt 17 is flat and not in contact with the facing roller 24.

The facing roller 24 is provided so that the wave of the belt near the contact position between the rigid blade 21 and the intermediate transfer belt 17 is stable and the contact state is stable. By shifting the rigid blade 21 from the position around the facing roller 24, it is possible to avoid the cleaning defects at that position when foreign substances are attached to the belt back surface.

Also in a case where minute cracks (microcracks) are generated on the surface with use as a phenomenon caused when the intermediate transfer belt 17 is used, it is possible to avoid the damage of the intermediate transfer belt 17 and the generation of the cleaning defects due to the rigid blade 21 being stuck in the microcracks by shifting the contact position of the rigid blade 21 from the position around the facing roller 24.

The facing roller 24 may not be provided to the back surface of the intermediate transfer belt 17 if the waving of the intermediate transfer belt 17 can be stabilized by another method.

The waste toners which were collected from the intermediate transfer belt 17 by the rigid blade 21 are accumulated in a casing of the belt cleaning section 20 and ejected from the belt cleaning section 20 by a conveyance member which is not shown in the drawings.

EMBODIMENTS

Hereinafter, embodiments of the present invention and comparison examples will be described.

<Evaluation of Cleaning Property>

In the image forming apparatus (bizhubPRESSC8000) shown in FIG. 1, image formation was performed to 10,000 sheets under a high-temperature high-humidity environment (30° C. and 80%) by using intermediate transfer belts and blades of embodiments 1 to 5 and comparison examples 1 to 7. After the formation of abrasion surface at the contact angle under the high-temperature high-humidity environment, the cleaning property when image formation was performed to 100 sheets under a low-temperature low-humidity environment (10° C. and 20%) was evaluated in accordance with the following evaluation standard.

The results are shown in the table 1.

The evaluation was performed with the free length of the rigid blade of 10 mm and the angle difference between the effective contact angle and the pivot angle of 0°, 3°, 5° and 10°.

The same evaluation was performed with the free length of the rigid blade of 5 mm, 15 mm and 20 mm, and the results showed the same trend as the case of the free length of 10 mm.

<Evaluation Standard>

◎: No cleaning defects (going through of toners). Good cleaning.

○: Blade is thick. Followability of blade to belt (or followability of belt to blade) is concerned, but allowable.

X: Cleaning defects occur.

Embodiment 1

There was used an intermediate transfer belt which includes a base layer (polyimide: PI) formed of a resin with a thickness of 70 μm and an elastic layer (nitrile-butadiene rubber. NBR) with a thickness of 200 μm having elasticity and has a surface hardness 120 MPa by surface hardening processing.

There was used a rigid blade made of SUS (stainless steel) with a thickness of 100 μm, a Young's modulus of 200 GPa and a Vickers hardness of 400 HV.

As the other condition, the contact pressure was 20 N/m.

Embodiment 2

There was used a same intermediate transfer belt as that of the embodiment 1.

There was used a rigid blade which is same as that of the embodiment 1 except that the Vickers hardness is 2000 HV (DLC plating).

The other conditions were same as those of the embodiment 1.

Embodiment 3

There was used a same intermediate transfer belt as that of the embodiment 1.

There was used a rigid blade which is same as that of the embodiment 1 except that the thickness is 300 μm.

The other conditions were same as those of the embodiment 1.

Embodiment 4

There was used a same intermediate transfer belt as that of the embodiment 1.

There was used a rigid blade which is same as that of the embodiment 1 except that the thickness is 200 μm.

The other conditions were same as those of the embodiment 1.

Embodiment 5

There was used an intermediate transfer belt which has a same layer configuration as that of the embodiment 1 and has a surface hardness 150 MPa by surface hardening processing.

There was used a same rigid blade as that of the embodiment 1.

The other conditions were same as those of the embodiment 1.

Comparison Example 1

There was used a same intermediate transfer belt as that of the embodiment 1.

There was used a rigid blade which is same as that of the embodiment 1 except that the thickness is 500 μm.

The other conditions were same as those of the embodiment 1.

Comparison Example 2

There was used a same intermediate transfer belt as that of the embodiment 1.

There was used a rigid blade which is same as that of the embodiment 1 except that the thickness is 50 μm.

The other conditions were same as those of the embodiment 1.

Comparison Example 3

There was used a same intermediate transfer belt as that of the embodiment 1.

There was used a blade formed of resin (PET) with a thickness of 100 μm and Young's modulus of 4 GPa instead of the rigid blade.

The other conditions were same as those of the embodiment 1.

Comparison Example 4

There was used a same intermediate transfer belt as that of the embodiment 1.

There was used a blade formed of resin (PET) with a thickness of 300 μm and Young's modulus of 4 GPa instead of the rigid blade.

The other conditions were same as those of the embodiment 1.

Comparison Example 5

There was used a same intermediate transfer belt as that of the embodiment 1.

There was used a blade formed of resin (PET) with a thickness of 500 μm and Young's modulus of 4 GPa instead of the rigid blade.

The other conditions were same as those of the embodiment 1.

Comparison Example 6

There was used an intermediate transfer belt which has a same layer configuration as that of the embodiment 1 and has a surface hardness 50 MPa by surface hardening processing.

There was used a same rigid blade as that of the embodiment 1.

The other conditions were same as those of the embodiment 1.

Comparison Example 7

There was used an intermediate transfer belt which has a same layer configuration as that of the embodiment 1 and has a surface hardness 180 MPa by surface hardening processing.

There was used a same rigid blade as that of the embodiment 1.

The other conditions were same as those of the embodiment 1.

TABLE 1

| | INTERMEDIATE TRANSFER BELT | BLADE | | | DIFFERENCE BETWEEN EFFECTIVE CONTACT ANGLE AND PIVOT ANGLE(° ) | | | |
|---|---|---|---|---|---|---|---|---|
| | SURFACE HARDNESS | MATERIAL | VICKERS HARDNESS | THICKNESS | 0 | 3 | 5 | 10 |
| EMBODIMENT 1 | 120 MPa | SUS | 400 HV | 100 μm | ◎ | ◎ | ○ | ○ |
| EMBODIMENT 2 | 120 MPa | SUS | 2000 HV | 100 μm | ◎ | ◎ | ○ | ○ |
| EMBODIMENT 3 | 120 MPa | SUS | 400 HV | 300 μm | ○ | ○ | ○ | ○ |
| EMBODIMENT 4 | 120 MPa | SUS | 400 HV | 200 μm | ◎ | ◎ | ○ | ○ |
| EMBODIMENT 5 | 150 MPa | SUS | 400 HV | 100 μm | ○ | ○ | ○ | ○ |
| COMPARATIVE EXAMPLE 1 | 120 MPa | SUS | 400 HV | 500 μm | X | X | X | X |
| COMPARATIVE EXAMPLE 2 | 120 MPa | SUS | 400 HV | 50 μm | X | X | X | X |
| COMPARATIVE EXAMPLE 3 | 120 MPa | RESIN (PET) | — | 100 μm (YOUNG'S MODULUS 4 GPa) | X | X | X | X |
| COMPARATIVE EXAMPLE 4 | 120 MPa | RESIN (PET) | — | 300 μm (YOUNG'S MODULUS 4 GPa) | X | X | X | X |
| COMPARATIVE EXAMPLE 5 | 120 MPa | RESIN (PET) | — | 500 μm (YOUNG'S MODULUS 4 GPa) | X | X | X | X |
| COMPARATIVE EXAMPLE 6 | 50 MPa | SUS | 400 HV | 100 μm | X | X | X | X |
| COMPARATIVE EXAMPLE 7 | 180 MPa | SUS | 400 HV | 100 μm | X | X | X | X |

The embodiments 1 to 5 show that good results are obtained by the thickness of the rigid blade which is 100 μm or more and 300 μm or less, and better results are obtained by the thickness of the rigid blade which is 100 μm or more and 200 μm or less.

When the thickness of the rigid blade is 100 μm or more and 300 μm or less and the difference between the effective contact angle and the pivot angle is 3° or less, better results are obtained.

The comparison example 1 is a configuration in which the change in contact angle is small. Though the edge lift does not occur easily, as an adverse effect, there was generated a cleaning defect by the toners going through due to the bad followability to the belt longitudinal direction.

The comparison example 2 is a configuration in which the change in contact angle is large, and there was generated a cleaning defect due to the edge lift.

As a result of the comparison examples 3 to 5, in a case of using a resin blade, there was generated a cleaning defect due to the edge lift regardless of the thickness.

As a result of the comparison example 6, though the rigid blade has an optimum configuration, the nanoindentation hardness of the outermost surface of the elastic layer is small. Thus, the outermost surface was excessively soft, the toners deformed the belt and went through under the blade, and a cleaning defect was generated.

As a result of the comparison example 7, though the rigid blade has an optimum configuration, the rigid blade is not deformable, and thus the contact irregularities exist in the ridge direction of the rigid blade. Thereby, the surface of the intermediate transfer belt having an excessively high surface hardness could not follow without a gap in the ridge direction of the rigid blade, minute space was generated, toners went through and a cleaning defect was generated.

As described above, according to an embodiment, an image forming apparatus 100 transfers toner images formed on an intermediate transfer belt 17 onto the sheet P and forms an image. The intermediate transfer belt 17 has a base layer 173 and an elastic layer 172, and the surface hardness of the elastic layer 172 measured by the nanoindentation method is 70 MPa or more and 150 MPa or less. The image forming apparatus 100 includes a belt cleaning section 20 which has a metallic rigid blade 21 that contacts the intermediate transfer belt 17 after the toner images were transferred onto the sheet P and cleans the residues attached to the surface of the intermediate transfer belt 17. The thickness of the rigid blade 21 is 100 μm or more and 300 μm or less.

Thus, good cleaning property can be achieved regardless of the use conditions.

Although embodiments of the present invention have been described and illustrated in detail, it is clearly understood that the same is by way of illustration and example only and not limitation, the scope of the present invention should be interpreted by terms of the appended claims.

Japanese Patent Application No. 2016-173257 filed on Sep. 6, 2016, including description, claims, drawings, and abstract the entire disclosure is incorporated herein by reference in its entirety.

What is claimed is:

1. An image forming apparatus which transfers a toner image formed on an image carrier onto a transfer object and forms an image, the apparatus comprising:

a cleaner which has a rigid blade made of metal that contacts the image carrier after transferring of the toner image onto the transfer object and cleans a residue attached to a surface of the image carrier, wherein:

the image carrier has a base layer, an elastic layer, and a surface layer, and a surface hardness of the surface layer measured by a nanoindentation method is 70 MPa or more and 150 MPa or less, a thickness of the rigid blade is 100 μm or more and 300 μm or less, and an angle obtained by subtracting a pivot angle from an effective contact angle is 3° or less, the pivot angle being an angle between the image carrier and a virtual line connecting a rotation pivot of the rigid blade and a contact position between the rigid blade and the image carrier, and the effective contact angle being an angle between the image carrier and the rigid blade when the image carrier contacts the rigid blade and the rigid blade bends.

2. The image forming apparatus according to claim 1, wherein the thickness of the rigid blade is 100 μm or more and 200 μm or less.

3. The image forming apparatus according to claim 1, wherein a Vickers hardness of the rigid blade is 100 HV or more and 3000 HV or less.

4. The image forming apparatus according to claim 1, wherein the image carrier is provided so as to bridge a plurality of rollers, and at a position facing an edge of the rigid blade, the image carrier is flat and does not contact the plurality of rollers.

5. The image forming apparatus according to claim 1, wherein a contact angle is 10° or more and 15° or less, the contact angle being an angle in an initial state in which the image carrier contacts the rigid blade.

6. The image forming apparatus according to claim 1, wherein an edge of the rigid blade which contacts the image carrier has a round shape of a curvature radius of 4 μm or more and 10 μm or less.

7. A cleaning apparatus which cleans an image carrier after a toner image formed on the image carrier is transferred onto a transfer object, the apparatus comprising:

a rigid blade made of metal that contacts the image carrier after transferring of the toner image onto the transfer object, and cleans a residue attached to a surface of the image carrier, wherein:

the image carrier has a base layer, an elastic layer, and a surface layer, and a surface hardness of the surface layer measured by a nanoindentation method is 70 MPa or more and 150 MPa or less, a thickness of the rigid blade is 100 μm or more and 300 μm or less, and an angle obtained by subtracting a pivot angle from an effective contact angle is 3° or less, the pivot angle being an angle between the image carrier and a virtual line connecting a rotation pivot of the rigid blade and a contact position between the rigid blade and the image carrier, and the effective contact angle being an angle between the image carrier and the rigid blade when the image carrier contacts the rigid blade and the rigid blade bends.

8. The cleaning apparatus according to claim 7, wherein the thickness of the rigid blade is 100 μm or more and 200 μm or less.

9. The cleaning apparatus according to claim 7, wherein a Vickers hardness of the rigid blade is 100 HV or more and 3000 HV or less.

10. The cleaning apparatus according to claim 7, wherein the image carrier is provided so as to bridge a plurality of rollers, and at a position facing an edge of the rigid blade, the image carrier is flat and does not contact the plurality of rollers.

11. The cleaning apparatus according to claim 7, wherein a contact angle is 10° or more and 15° or less, the contact angle being an angle in an initial state in which the image carrier contacts the rigid blade.

12. The cleaning apparatus according to claim 7, wherein an edge of the rigid blade which contacts the image carrier has a round shape of a curvature radius of 4 μm or more and 10 μm or less.

* * * * *